US006029825A

United States Patent [19]

Pfeffer et al.

[11] Patent Number: 6,029,825

[45] Date of Patent: Feb. 29, 2000

[54] PRESSURE SORTER FOR SORTING FIBER SUSPENSIONS AS WELL AS SCREEN FOR SUCH A PRESSURE SORTER

[75] Inventors: Jochen Gustav Pfeffer, Eningen; Erich Czerwoniak, Pfullingen, both of Germany

[73] Assignee: Hermann Finckh Maschinenfabrik GmbH & Co., Pfullingen, Germany

[21] Appl. No.: 08/898,672

[22] Filed: Jul. 22, 1997

Related U.S. Application Data

[63] Continuation of application No. PCT/EP95/00388, Feb. 3, 1995.

[51] Int. Cl.[7] ..... B07B 1/20

[52] U.S. Cl. ..... 210/414; 210/415; 210/498; 209/273; 209/306; 209/397; 162/55; 162/57; 162/58; 29/896.62

[58] Field of Search ..... 210/498, 499, 210/414, 415; 209/273, 306, 397; 162/55, 57, 58; 29/896.62

[56] References Cited

U.S. PATENT DOCUMENTS

| | | | |
|---|---|---|---|
| 4,529,520 | 7/1985 | Lampenius | 210/498 |
| 4,832,832 | 5/1989 | Fujiwara et al. | 209/273 |
| 5,011,065 | 4/1991 | Musselmann . | |
| 5,384,046 | 1/1995 | Lotter et al. | 210/484 |

FOREIGN PATENT DOCUMENTS

| | | |
|---|---|---|
| 205 623 | 12/1986 | European Pat. Off. . |
| 294 832 | 12/1988 | European Pat. Off. . |
| 316 570 | 5/1989 | European Pat. Off. . |
| 521 192 | 7/1993 | European Pat. Off. . |
| WO 94/00634 | 1/1994 | European Pat. Off. . |
| 91 08 129 | 9/1991 | Germany . |
| 91 08 129 U | 10/1991 | Germany . |
| 2 067 911 | 5/1981 | United Kingdom . |

OTHER PUBLICATIONS

W. Tangsaghasaksri et al., "EinfluB von Schlitz–Konturen auf den Faserdurchgang—Untersuchungen mit Hilfe eines Modell–Sortierers" (Teil 1), *Das Papier*, pp. 172–179, Heft 4 1994.

W. Tangsaghasaksri et al., "EinfluB von Schlitz–Konturen auf den Faserdurchgang—Untersuchungen mit Hilfe eines Modell–Sortierers" (Teil 2), *Das Papier*, pp. 235–247, Heft 5 1994.

W. Tangsaghasaksri et al., "Modellierung des Faserdurchgangsverhaltens bei Suspensionsströmung durch Sortierschlitze", *Das Papier*, pp. 635–638, Heft 10 1994.

*Primary Examiner*—David A. Reifsnyder
*Attorney, Agent, or Firm*—Leydig, Voit & Mayer, Ltd.

[57] ABSTRACT

A sieve for sorting fiber suspensions, symmetrical in relation to an axis, with an inflow side for the fiber suspension to be sorted and an opposite outflow side. This sieve is useful for pressure sorting machines having a rotor that may be rotated around the axis of the sieve and that is provided with profiled elements around the inflow side of the sieve in order to generate positive and negative pressure pulses in the fiber suspension that is to be sorted. The inflow side of the sieve has grooves approximately parallel to the axis of the sieve that follow each other in the circumferential direction of the sieve. A through-channel opens into each groove. The grooves are delimited by a front and a rear side wall, seen in the direction of rotation of the profiled elements. In order to increase the capacity of the pressure sorting machine, the grooves have an approximately V-shaped cross section in a section perpendicular to the axis of the sieve and the front sidewall of the groove forms an angle from approximately 40° to approximately 70° with the circumference of the sieve.

36 Claims, 7 Drawing Sheets

PRESSURE SORTER FOR SORTING FIBER SUSPENSIONS AS WELL AS SCREEN FOR SUCH A PRESSURE SORTER

The present invention is a continuation of PCT/EP95/00388 (International Publication No. WO 96/23930), filed Feb. 3, 1995, which application elected the United States of America. The entire contents of this prior application are incorporated by reference.

The invention relates to a pressure sorter for fiber suspensions, in particular for the preparation of fiber suspensions recovered from waste paper, comprising a housing, in which a stationary screen rotationally symmetric to a screen axis is arranged, this screen separating in the housing a supply chamber encircled by the screen from an accepts chamber located outside the screen, wherein supply chamber and accepts chamber communicate with one another via through channels located in the screen wall, as well as a rotor drivable about the screen axis by a motor, an inlet for the fiber suspension to be treated communicating with a first axial end of the supply chamber, an accepts outlet communicating with the accepts chamber and a rejects outlet communicating with a second axial end of the supply chamber, wherein for generating positive and negative pressure pulses in the fiber suspension to be treated the rotor has a plurality of profiled elements arranged in the supply chamber and following one another in the circumferential direction of the rotor, these profiled elements each having a first flank located in front in rotational direction as well as approximately parallel to the screen axis for driving the fiber suspension to be treated in rotational direction of the rotor as well as a second flank located behind the first flank in a direction opposite to the rotational direction for drawing liquid back from the accepts chamber through the screen into the supply chamber.

The invention relates, in particular, to a pressure sorter of this type, such as disclosed and claimed in WO 94/00634 of the company Hermann Finckh Maschinenfabrik GmbH & Co.

Furthermore, the invention relates to a screen for sorting fiber suspensions, which is designed to be rotationally symmetric to a screen axis and has an inflow side for the fiber suspension to be sorted as well as an outflow side located opposite thereto, for pressure sorters comprising a rotor which can be driven rotationally about the screen axis and has profiled elements rotating adjacent to the inflow side of the screen for generating positive and negative pressure pulses in the fiber suspension to be sorted, wherein the screen has at its inflow side grooves extending approximately parallel to the screen axis and following one another in circumferential direction of the screen, each of these grooves—when seen in the direction of rotation of the profiled elements—being limited by a front as well as a r ear groove side wall and having a groove base, into which at least one screen through-channel opens, and wherein the front groove side wall is inclined to a greater extent in relation to the circumferential direction of the screen than the rear groove side wall. The invention relates, in particular, to a screen of this type for a pressure sorter of the type described above.

The invention relates, in particular, to such a screen, with which the grooves on the inflow side and the screen through-channels are formed in a screen wall rotationally symmetric to the screen axis and consisting of a stainless sheet steel.

A screen with the features specified above is known, for example, from FIG. 2*a* of U.S. Pat. No. 4,529,520.

The influence of the profiling on the inflow side of the screen of pressure sorters, but also the configuration as well as the arrangement of the actual screen openings or rather screen through-channels determining the sorting fineness, on the operating characteristics of pressure sorter screens is described in detail in the following articles from the magazine "Das Papier", Vol. 1994, Nos. 4, 5 and 10: "Einfluss von Schlitz-Konturen auf den Faserdurchgang—Untersuchung mit Hilfe eines Modell-Sortierers", pages 172–179 and 235–247 as well as "Modellierung des Faserdurchgangsverhaltens bei Supensionsströmung durch Sortierschlitze", pages 635–638. Diagram 5 on page 177 of the first article cited above illustrates inflow sides of pressure sorter screens contoured by means of grooves, the screen through-channels of which are slots extending parallel to the screen axis as well as having suspension flowing through them radially in relation to the screen axis and the grooves of which likewise extend parallel to the screen axis and have in cross section at right angles to the screen axis a V-shaped cross section, the angle bisector of which extends radially in relation to the screen axis, wherein the slot-shaped screen through-channels open either exactly in the groove base or in the front or rear groove side wall, when seen in the rotational direction of the rotor, namely each approximately at half the height of the relevant groove side wall. The two groove side walls are each inclined in relation to the circumferential direction of the screen through an angle of 45° so that they form an angle of 90° with one another. The depth of the grooves is 1 mm, the groove width measured in circumferential direction of the screen is, consequently, 2 mm.

With respect to their operational characteristics in pressure sorters of the type mentioned at the outset, those screens of the company Hermann Finckh Maschinenfabrik GmbH & Co. have proven to be particularly successful which have a screen wall rotationally symmetric to the screen axis and consisting of a stainless sheet steel and which possess grooves extending approximately parallel to the screen axis and following one another in circumferential direction of the screen at their inflow side, each of these grooves having in cross section at right angles to the screen axis a V-shaped cross section, the angle bisector of which extends radially in relation to the screen axis, wherein the two groove side walls form between them an angle of 120° and the screen through-channel which likewise has suspension flowing through it radially in relation to the screen axis opens exactly in the groove base. Measured in radial direction in relation to the screen axis, the grooves are between 0.8 mm and 1.0 mm deep (for the sorting of fiber suspensions with a majority of relatively short fibers a lesser groove depth has proven to be advantageous, for long fibers a greater groove depth). At the inflow side of the screen, a surface area essentially smooth and at least approximately parallel to the circumferential direction of the screen is provided between each two consecutive grooves in the circumferential direction of the screen, the width of this surface area measured in circumferential direction of the screen being 0.5 mm. This profiling of the inflow side of the screen has proven to be successful for the following reasons:

So that the screen through-channels do not become clogged at the inflow side during operation of a pressure sorter as a result of impurities contained in the fiber suspension to be sorted and a high throughput capacity of fiber suspension to be treated results per unit of time, the fiber suspension to be sorted is accelerated and driven with the aid of the rotor in its direction of rotation at the inflow side of the screen, and as a result of a corresponding profiling of the circumferential surface of the rotor positive and negative pressure pulses are thereby generated in the fiber suspension to be sorted. As a result of the negative pressure pulses, liquid is continuously being drawn out of that part of the fiber suspension which has already passed through the screen and back through the screen through-channels to the screen inflow side, whereby the screen through-channels are rinsed and clogging prevented. In addition, turbulences are generated in the fiber suspension which is still to be sorted and flows along at the screen inflow side as a result of the grooves, due to which the formation of a fiber fleece can be prevented at the inflow side of the screen; this fiber fleece would diminish the throughput capacity of the pressure sorter and usable fibers would also be retained as a result of it. Turbulences which are strong enough for this purpose do, however, require a certain minimum depth of the specified grooves. The first, front groove side walls in rotational direction of the fiber suspension to be sorted are the cause of the formation of these turbulences; these generate an underpressure in the fiber suspension which is still to be sorted and flows essentially along the inflow side of the screen in the circumferential direction thereof in the region of the respective front groove side wall, this underpressure being all the greater the steeper this front groove side wall is, i.e. the more this is inclined in relation to the circumferential direction of the screen (in cross section at right angles to the screen axis). However, a high underpressure of this type does lead, of course, to a reduction in the throughput capacity of the pressure sorter. That portion of the fiber suspension flowing essentially along at the inflow side of the screen in circumferential direction of the screen, which is deflected into the groove on account of the specified underpressure, partially strikes the second groove side wall to the rear in the direction of flow and is deflected by this wall into the main stream of the fiber suspension still to be sorted, whereby any fiber fleece possibly in the process of formation is destroyed again at least partially. On account of the course of the flow in the groove as described, it is also understandable that any screen through-channel opening into the groove side wall located downstream, i.e. to the rear, is subject to the risk of becoming clogged relatively quickly by fibers and impurities, fiber bundles and the like contained in the fiber suspension. With all these procedures, an abrasive wear and tear of the screen at its inflow side also plays a considerable part: Fiber suspensions recovered from waste paper, above all, contain many kinds of abrasively acting components, such as sand, metallic components and the like originating from wires, paper clips and the like. The more the abrasive wear and tear of the inflow side of the screen progresses, the smaller the depth of the grooves is and the turbulences indispensable for keeping the screen through-channels free become all the weaker. Therefore, the grooves must also be produced with a certain minimum depth for this reason. It is also of advantage, mainly on account of this abrasive wear and tear on the inflow side of the screen, when surface areas which are plane and parallel to the circumferential direction of the screen are provided at the inflow side of the screen between the grooves since, if the grooves were to border directly on one another in circumferential direction of the screen, acute-angled contours would result (in cross section at right angles to the screen axis) between the rear groove side wall and the front groove side wall of two consecutive grooves, which contours would be rapidly worn down by the abrasive components of the fiber suspension, with the result that the depth of the grooves would quickly decrease and the turbulences rapidly become weaker.

Ever greater throughput capacities are now required from pressure sorters; the throughput capacity does, however, depend essentially on the so-called free, through surface area of the screen (sum of the inside cross-sectional surface areas of the screen through-channels) which, in the case of a screen with a predetermined length and predetermined diameter, is all the greater, the more screen through-channels and thus the more grooves the screen has, i.e. the smaller the so-called division of the screen is (distance measured in circumferential direction of the screen between the centers of screen through-channels following one another in this direction). In the case of the pressure sorter screen described above of the company Hermann Finckh Maschinenfabrik GmbH & Co., which displays extremely favorable operational characteristics, the screen division is 3.2–4.0 mm depending on the groove depth.

Tests carried out by Hermann Finckh Maschinenfabrik GmbH & Co. have shown that an increase in the throughput capacity via an increase in the free, through surface area of the screen by reducing the screen division as a result of a reduction in the angle formed by the two groove side walls (a decrease in the groove depth likewise having an effect in the sense of a reduction in the screen division is out of the question for the reasons given above on account of the weakening in the turbulences associated therewith) is not possible and even leads to a reduction in the throughput capacity on account of screen through-channels quickly becoming clogged as well as to the fact that the proportion of longer, still usable fibers which pass through the screen and can reach its outflow side is reduced in an altogether undesired manner.

The object underlying the invention was to create a screen which has grooves generating turbulences at its inflow side, such as those of the screen of Hermann Finckh Maschinenfabrik GmbH & Co. described in the above, with which a greater throughput capacity can be achieved without the durability or service life of the screen, dependent inter alia on its wear characteristics, being impaired.

It has surprisingly been shown that this object may be accomplished in accordance with the invention as follows: The approximately V-shaped cross section of the groove (in cross section at right angles to the screen axis) is retained but use is made of the feature known per se (cf. in this respect FIG. 2*a* of U.S. Pat. No. 4,529,520) that the front groove side wall is inclined to a greater extent in relation to the circumferential direction of the screen than the rear groove side wall, wherein, however, in order to limit the underpressure resulting in the region of the front groove side wall the front groove side wall is inclined such that it forms with the circumferential direction of the screen an angle of approximately 40° to approximately 70°.

In this connection, it is to be noted that in the case of the known pressure sorter screen according to FIG. 2*a* of U.S. Pat. No. 4,529,520 the groove has in cross section at right angles to the screen axis a relatively long (measured in circumferential direction of the screen), plane bottom approximately parallel to the circumferential direction of the screen between the front and the rear groove side walls, the screen through-channel opening into this bottom, that the front groove side wall extends approximately at right angles to the circumferential direction of the screen, i.e. forms with this an angle of approximately 90°, and that the rear groove side wall is intended to be inclined in relation to the circumferential direction of the screen through 5° to 60° and preferably through 30°. As is shown by the preceding explanations, this known screen has two decisive disadvantages: The plane groove bottom forming the groove base leads in conjunction with an indispensable minimum depth of the grooves to a relatively large screen division and thus to a relatively small free, through surface area of the screen, and the front groove side wall at right angles to the circumferential direction of the screen results in a relatively large underpressure which reduces the throughput capacity of the pressure sorter resulting in the region of the groove base and thus in the region of the opening of the screen through-channel.

As a result of the front groove side wall of the inventive screen which extends more steeply in comparison with the known screen described above of Hermann Finckh Maschinenfabrik GmbH & Co., a smaller screen division and thus a greater free, through surface area can be achieved without reducing the depth of the grooves and without having to forego the advantages of this known screen as explained above or accept the disadvantage described above that the throughput capacity of the screen is again reduced as a result of a front groove side wall which is inclined to too great an extent in relation to the circumferential direction of the screen. Tests have shown that with an inventive screen and a relatively low material density of the fiber suspension to be sorted the amount of fiber suspension which can be processed per unit of time increases proportionally to the increase in size of the free, through surface area of the screen, with an increasing material density of the fiber suspension even overproportionally, without an inventive screen being more susceptible to wear and tear than the known screen as described of Hermann Finckh Maschinenfabrik GmbH & Co.

It should also be mentioned that the screen through-channels need not open absolutely exactly in the groove base, i.e. in the tip of the approximately V-shaped groove cross section, but can also be offset somewhat upstream relative to the groove base, i.e. can open in the lower quarter or lower third of the front groove side wall without greater disadvantages thereby having to be accepted, as would be the case if the screen through-channels were to open into the rear groove side wall (risk of clogging of the screen through-channels) or were to open into the front groove side wall higher up (decreased service life of the screen because the openings of the screen through-channels would come rapidly closer to the screen circumference on the inflow side due to an abrasive wear and tear of the inflow side of the screen and the screen would, as a result, tend relatively soon to clogging of its through channels).

The properties of the inventive screen with respect to the throughput capacity which can be achieved and its operational characteristics can be improved all the more, proceeding on the basis of the basic concept of the invention as described above, the more the inclination of the front groove side wall in relation to the circumferential direction of the screen approaches an angle of approximately 52° or approximately 53°, and an optimum results with an angle of inclination of 37.5°, above all when the screen through-channel opens exactly in the groove base and has suspension flowing through it radially in relation to the screen axis.

The same applies for the inclination of the rear groove side wall, i.e. located downstream, when its angle of inclination is, namely, brought closer to that of the rear groove side wall of the known screen described above of the company Hermann Finckh Maschinenfabrik GmbH & Co.—optimum properties therefore arise when the rear groove side wall forms an angle of approximately 30° with the circumferential direction of the screen.

The comments made in the above for the known screen as described of Hermann Finckh Maschinenfabrik GmbH & Co. also apply for the depth of the grooves, wherein a value of approximately 1 mm has been determined as optimum value for the depth of the grooves.

With respect to the service life, i.e. the wear and tear characteristics, of the inventive screen, it is also of advantage in this case when a surface area which is essentially smooth and at least approximately parallel to the circumferential direction is provided at the inflow side of the screen in its circumferential direction between each two consecutive grooves, the width of this surface area measured in circumferential direction preferably corresponding to approximately 20% to approximately 30% of the width of the grooves, and a width of this surface area which is approximately equal to ⅕ of the width of the grooves has proven to be particularly advantageous.

Although the screen through-channels can also be bores with, consequently, a circular cross section and several such bores, which are located behind one another in directions approximately parallel to the screen axis and extend, for example, radially in relation to the screen axis, can then open into each of the grooves on the inflow side, embodiments of the inventive screen are preferred, in which the screen through-channels have the shape of slots which extend (when looking at the inflow side of the screen) approximately parallel to the screen axis because screens with a greater free, through surface area and thus pressure sorters with a greater throughput capacity result with such slots. Above all for screens with slot-like screen through-channels, it is recommended with a view to as high a strength of the screen wall as possible that the screen be designed such that only one single screen through-channel opens into each of the grooves on the inflow side since the grooves on the inflow side (measured in the direction of the screen axis) need not be or (for reasons of production) only insignificantly longer than the slots forming the screen through-channels. Likewise for reasons of as high a strength of the screen as possible, it is of advantage when (when looking at the inflow side of the screen) the grooves form several rows of grooves extending in circumferential direction of the screen and arranged in spaced relation to one another in the direction of the screen axis.

Although in the case of a screen with a screen wall produced from sheet steel the grooves on the inflow side could be produced with any known machining technique, e.g. by the metal in the region of the grooves to be produced being volatilized by means of a beam of energy (laser or electron beam) (the screen through-channels could also be produced with such a beam of energy), it is recommended with the present state of the art, for reasons of production costs as well as the precision of the contours to be produced in the screen wall, that the grooves be designed as recesses produced by a cutting process so that they can be produced, in particular, by means of a form cutter.

Again for reasons of the strength of the screen, it is recommended for such screens, the screen wall of which is produced from sheet steel, that a wall thickness of approximately 6 mm to approximately 10 mm and, in particular, of approximately 6 mm to approximately 8 mm be selected for the screen wall—outside the screen openings connecting the inflow side with the outflow side.

So that the flow resistance of the screen through-channels decisive for the sorting fineness is as low as possible and thus the throughput capacity which can be achieved as large as possible, preferred embodiments of the inventive screen, just like a large number of known pressure sorter screens, have recesses at their outflow sides, into each of which at least one screen through-channel opens; preferably, these recesses also have the shape of grooves extending approximately parallel to the screen axis, and as is apparent from the foregoing it is of advantage, above all, in the case of a screen with slot-shaped screen through-channels when only one single screen through-channel opens into each of the recesses on the outflow side.

In accordance with the preceding explanations, the subject matter of the invention is also a pressure sorter of the type disclosed and claimed in WO 94/00634, the screen of which is configured in accordance with the present invention, since it has been shown that an inventive screen leads to particularly good results in conjunction with a pressure sorter, the rotor of which is designed in the manner disclosed and claimed in WO 94/00634.

Additional features, advantages and details of the invention result from the attached claims and/or from the following description of particularly advantageous embodiments of the inventive pressure sorter as well as the inventive screen on the basis of the attached drawings; in the drawings:

Figure 1:
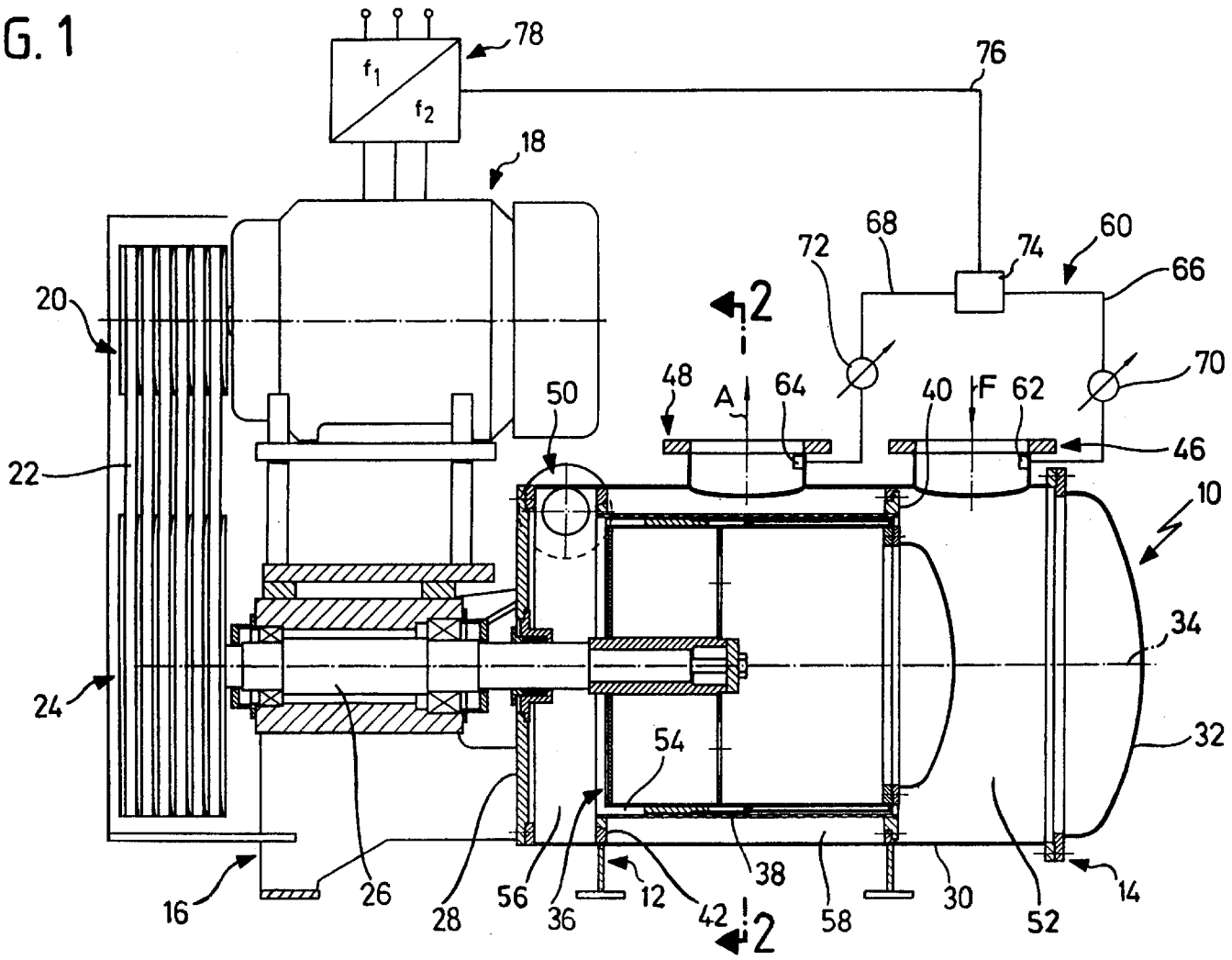
FIG. 1 shows a partially cutaway side view of the inventive pressure sorter, wherein the sectional illustration is a section in a vertical plane of diameter of the rotor or the screen.

The actual pressure sorter 10 illustrated in FIG. 1 and having a housing 14 resting on supports 12 also has a motor 18 standing on a frame 16; this motor is a rotary current or three-phase A.C. motor which drives a belt pulley 24 by means of a belt pulley 20 and V-belts 22, this belt pulley 24 being fixed to a rotor shaft 26 rotatably mounted in the frame 16 as well as in the housing 14.

The housing 14 essentially consists of a front wall 28 to the left according to FIG. 1, a circular cylindrical housing shell 30 arranged concentrically to the rotor shaft 26 as well as a housing cover 32 which are connected with each other so as to be pressure-tight. An axis of the pressure sorter which is also the axis of the rotor shaft 26 has been designated as 34.

The rotor shaft 26 guided through the front wall 28 in a pressure-tight manner bears a rotor designated as a whole as 36 which can be driven about the axis 34 with the aid of the rotor shaft 26 and is surrounded by a circular cylindrical screen 38 which is concentric to the axis 34, is attached to two circular ring-shaped housing elements 40 and 42 fixed to the housing shell 30 and is thus held by these housing rings.

In the illustrated embodiment, the axial length (in the direction of the axis 34) of the rotor 36 is equal to the axial length of the operative region of the screen 38 between the housing rings 40 and 42. It would, however, also be possible to select the axial length of the rotor 36 so as to be greater or smaller than the axial length of the screen 38 in order to achieve specific effects.

An intake connecting pipe 46 is provided at the right end of the housing 14 according to FIG. 1 and—as indicated by the arrow F—the fiber suspension to be prepared or to be sorted is conveyed into the pressure sorter through this intake connecting pipe, namely by means of a pump which is not illustrated. An outlet connecting pipe 48 is attached to the housing shell 30 approximately in the middle above the screen 38 and the so-called accepted material—as indicated by the arrow A—exits the pressure sorter through this outlet connecting pipe. The accepted material is that part of the fiber suspension which has passed through the screen 38.

Figure 2:
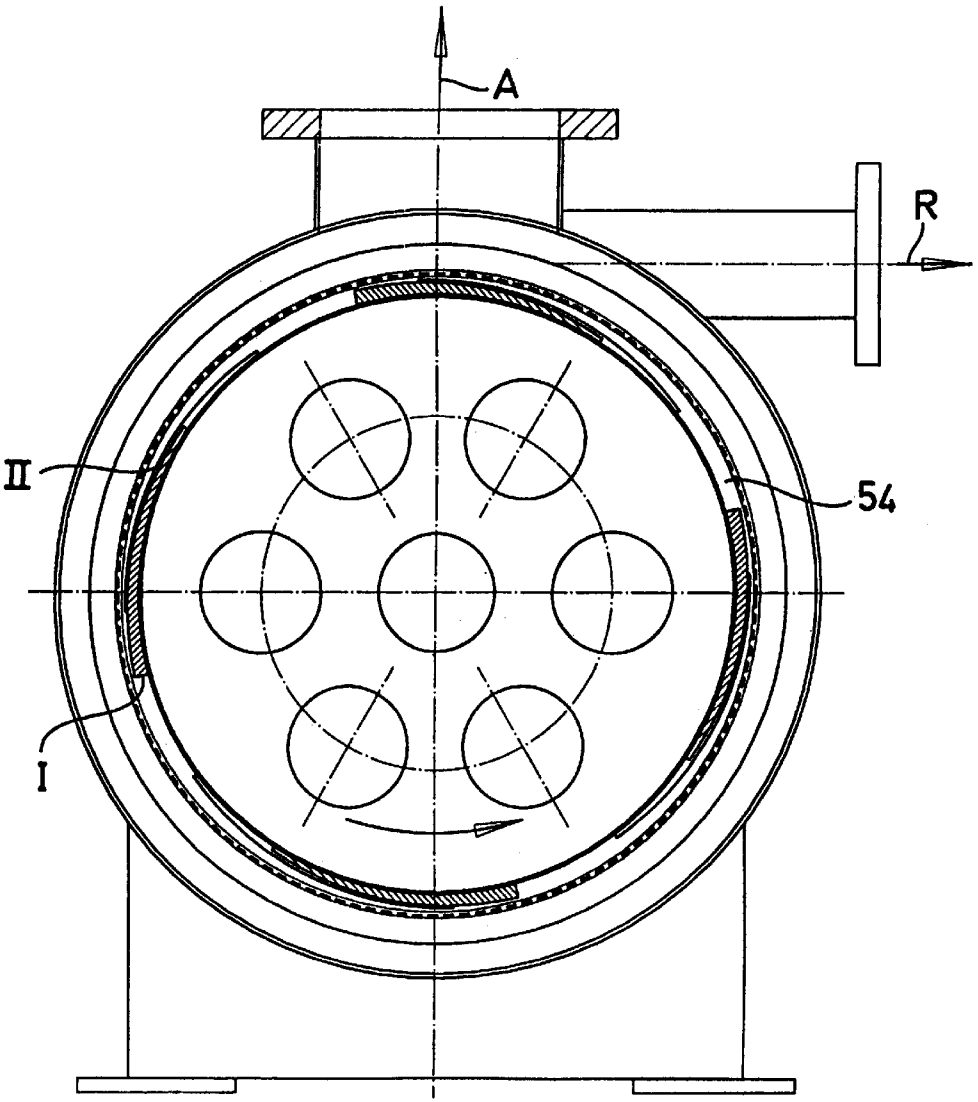
FIG. 2 shows a section along line 2—2 in FIG. 1.

Finally, a second outlet connecting pipe 50 is attached to the left end of the housing shell 30 according to FIG. 1 and the so-called rejected material—as indicated by the arrow R in FIG. 2—exits the pressure sorter through this outlet connecting pipe; the rejected material is that part of the fiber suspension to be prepared which cannot pass through the screen 38.

Contrary to the illustration in FIG. 1, the intake connecting pipe 46 will be expediently arranged such that the fiber suspension to be sorted flows approximately tangentially into the housing 14, in the same way as the outlet connecting pipe 50 for the rejected material is aligned tangentially (see FIG. 2). In addition, the outlet connecting pipe 48 could, of course, also be arranged at the bottom of the housing shell 30, insofar as the arrangement of the pressure sorter 10 allows for the drainage of accepted material downwards.

The fiber suspension to be prepared, which is fed into the pressure sorter 10 via an intake connecting pipe 46, passes first of all into an intake chamber 52 and it then enters an annular chamber between the circumference of the rotor 36 and the screen 38 which is designated in the following as supply chamber 54, and the fiber suspension to be sorted enters the latter via a first axial end 54*a* of this supply chamber. As a result of the rotor 36 rotating about the axis 34 as well as, where applicable, the tangential alignment of the intake connecting pipe 46 and due to the pressure, at which the fiber suspension to be sorted is conveyed into the pressure sorter 10, the fiber suspension flows in a helical line through the supply chamber 54 from its first end 54*a* to its second end 54*b*, wherein a portion of the fiber suspension passes through openings in the screen 38 and thus reaches the accepts chamber 58. The rejected material leaves the supply chamber 54 at its second end 54*b* and thus reaches the rejects chamber 56, from which the rejected material leaves the pressure sorter via the second outlet connecting pipe 50.

In preferred embodiments of the inventive pressure sorter, the axis 34 extends at least approximately horizontally; fundamentally, it would also be conceivable, however, to assemble the pressure sorter such that its axis 34 extends at least approximately vertically.

Due to the relatively fine openings of the screen 38, a pressure difference results between supply chamber 54 and accepts chamber 58, in fact the pressure in the accepts chamber is lower than in the supply chamber. In order to detect this pressure difference, a measuring device 60 is provided according to the invention and this comprises a first pressure transmitting means 62 and a second pressure transmitting means 64 which are arranged in the intake connecting pipe 46 and the first outlet connecting pipe 48, respectively, but could, however, also be arranged in the intake chamber 52 and the accepts chamber 58, respectively. They are connected with the inputs of a difference forming device 74 via lines 66 and 68, in which indicating devices 70 and 72 are arranged. This difference forming device delivers at its output a control signal proportional to the pressure difference, this signal being applied to the control input of a frequency converter 78 via a line 76. This converter is supplied by a current source which is not illustrated with a three-phase alternating current or rotary current having the frequency $f_1$ and delivers a three-phase alternating current having the frequency $f_2$ for driving the three-phase A.C. current motor 18, wherein the frequency $f_2$ is a function of the control signal generated by the difference forming device 74. In this manner, the rotor 36 is driven with a rotational speed which is a function of this control signal and, therefore, of the pressure difference between supply chamber 54 and accepts chamber 58. Instead of the indicating devices 70 and 72 or in addition to these, potentiometers or other regulating elements could also be provided in the lines 66 and 68, the signals delivered by the pressure transmitting means 62 and 64 being changeable by these regulating elements in order to be able to influence the dependence of the control signal applied to the line 76 on the mentioned pressure difference.

Figure 3:
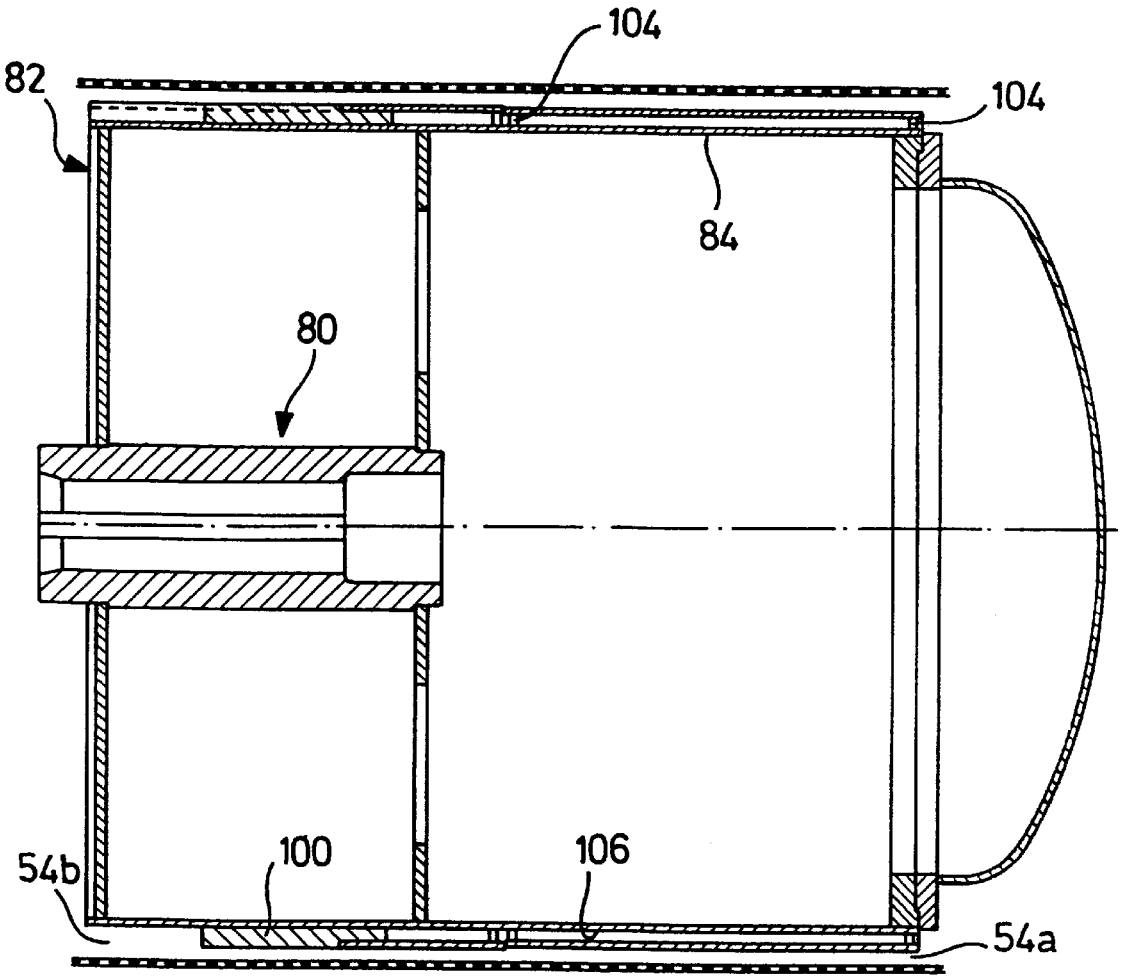
FIG. 3 shows screen and rotor of the pressure sorter as illustrated in FIG. 1 but on a larger scale than in FIG. 1, wherein the screen has been indicated only schematically in this case, as well.
Figure 4:
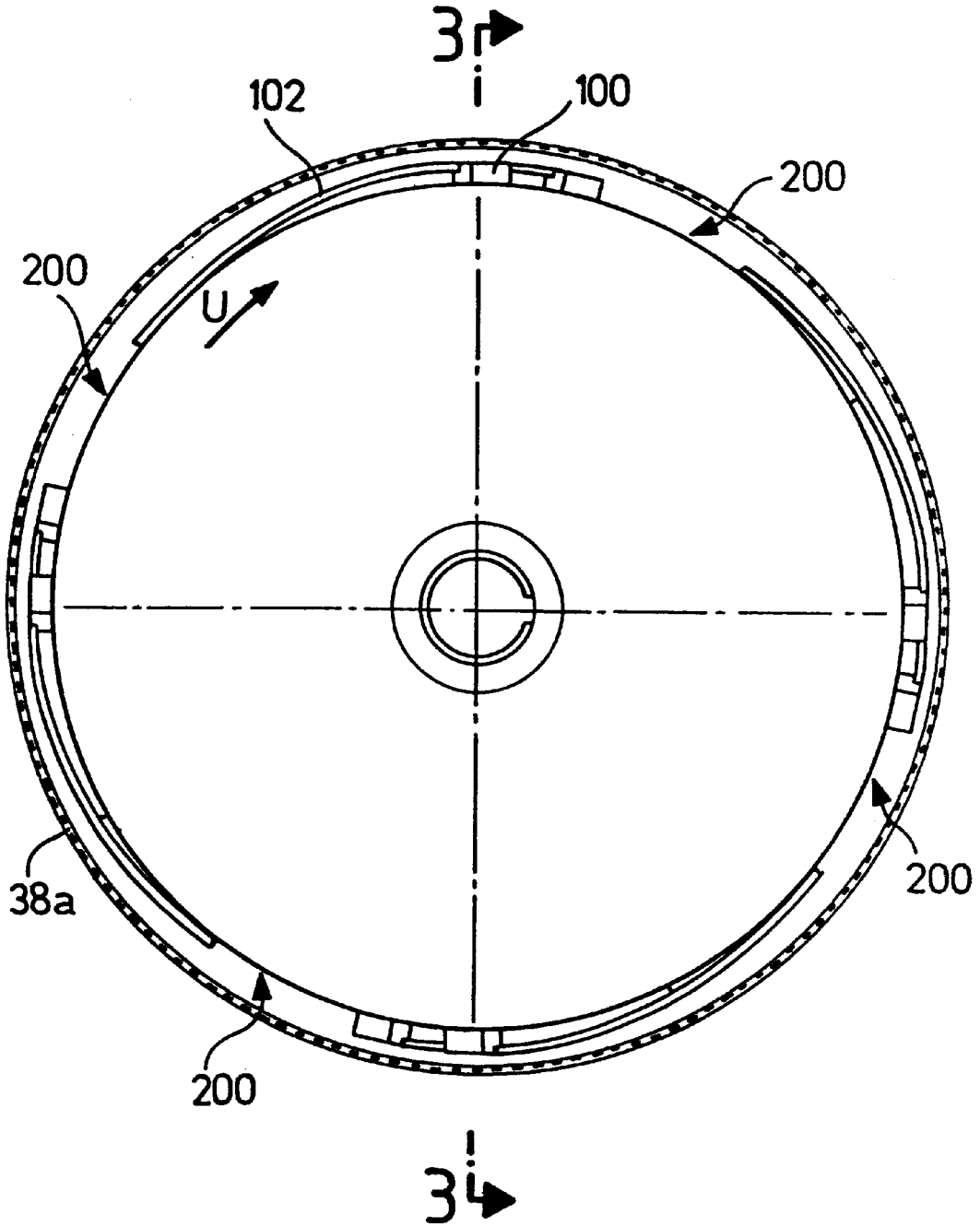
FIG. 4 shows a front view of the rotor, seen from the left according to FIG. 1, and namely together with a screen illustrated in an axial section.
Figure 5:
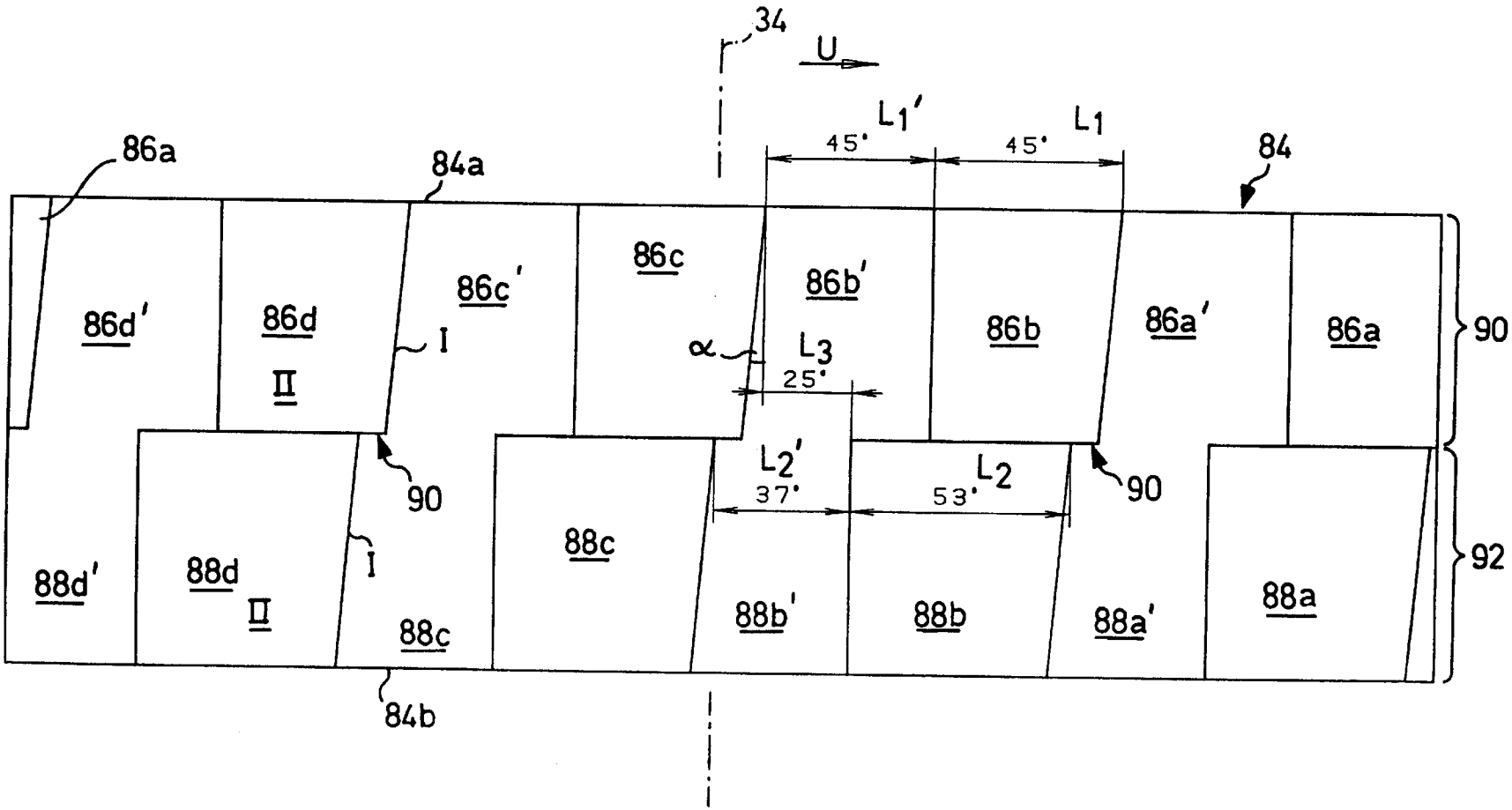
FIG. 5 shows a layout of the rotor circumference, i.e. a plan view of the entire circumferential surface of the rotor which has, however, been illustrated in one plane.

On the basis of FIGS. 3 to 5, the design of the rotor 36 is now to be explained in detail.

A hub 80 fixedly connected to the rotor shaft 26 bears a closed, hollow, circular cylindrical rotor body 82 with a circular cylindrical rotor casing 84. This has a first axial end 84*a* at the first axial end 54*a* of the supply chamber 54 and a second axial end 84*b* at the second axial end 54*b* of the supply chamber and bears two sets of profiled elements on the outside, namely a first set which is formed by profiled elements 86*a*, 86*b*, 86*c* and 86*d* as well as a second set formed by profiled elements 88*a*, 88*b*, 88*c* and 88*d*. The first set of profiled elements forms a first row of profiled elements extending in circumferential direction of the rotor or rotational direction U of the rotor with gaps 86*a*', 86*b*', 86*c*' and 86*d*' arranged between these elements, and this row defines a first axial rotor section 90 which faces the intake chamber 52; the second set of profiled elements 88*a*–88*d* forms a second, identical row of profiled elements and gaps 88*a*', 88*b*', 88*c*' and 88*d*' arranged therebetween, and this second row defines a second axial rotor section 92 which is adjacent to the rejects chamber 56. In the illustrated preferred embodiment, all the profiled elements are of the same height (measured in the direction of the axis 34); depending on the desired sorting result and/or as a function of the type of fiber suspension to be sorted, it could be expedient, however, to select the height of the first row so as to be greater or smaller than the height of the second row. In addition, it can be expedient to provide the rotor with more than two such rows.

As is shown particularly in FIGS. 2 and 4, each profiled element has a front surface or first flank I lying in front in rotational direction U and extending at right angles to the circular cylindrical, outer circumferential surface of the rotor casing 84 and, therefore, to the surface of the gap lying in front thereof in rotational direction U, as well as a rear surface or second flank II directly adjoining the first flank I, this second flank sloping downwards and inwardly in radial direction contrary to the rotational direction U and, therefore, towards the axis 34 so that the profiled elements have in the section at right angles to the axis 34 a cross section resembling a very acute-angled triangle which has been bent concentrically to the axis 34. Strong positive pressure pulses and strong turbulences are generated in the supply chamber 54 by the first flanks I; in addition, the fiber suspension in the supply chamber 54 is greatly accelerated by the first flanks I, namely at the most up to the rotational speed of the profiled elements. On the other hand, the downwardly sloping second flanks II generate negative pressure pulses, by means of which liquid is drawn back from the accepts chamber 58 through the screen openings and into the supply chamber 54. Particularly strong turbulences result in the supply chamber 54 due to the flow component of the fiber suspension directed in rotational direction U when the inner side of the screen 38 is designed in accordance with the invention so as to be "rough", i.e. profiled.

The first flanks I do not extend parallel to the axis 34 in preferred embodiments of the inventive pressure sorter but form an acute angle $\alpha$ with the direction of the axis 34, in fact the flanks I are inclined in relation to the direction of the axis 34 such that the flow component of the fiber suspension in the supply chamber 54 extending in the direction of the axis 34 is increased in the direction from the first axial end 54*a* of the supply chamber to its second axial end 54*b*.

As is apparent from FIG. 5, the profiled elements 86*a*–86*d* of the first row in the illustrated preferred embodiment are shorter—measured in circumferential direction of the rotor or rotational direction U—than the profiled elements 88*a*–88*d* of the second row. This measure serves the purpose of adapting the effect of the profiled elements to the varying consistency of the fiber suspension, the consistency of which increases in the supply chamber 54 from its first end 54*a* to its second end 54*b*. In the particularly advantageous embodiment illustrated in FIG. 5, each of the profiled elements 86*a*–86*d* of the first row extends over a circumferential angle of 45° (this is the maximum length $L_1$ of the profiled elements), wherein the length of the profiled elements decreases towards the second axial end 84*b* of the rotor casing 84 because the first flanks I extend at an angle to the direction of the axis 34 while the rear edges of the second flanks II are aligned parallel to the axis 34. The shortest length $L_1$' of the gaps 86*a*'–86*d*' of the first row is also 45° and, therefore, is equal to the greatest length $L_1$ of the profiled elements of this row, wherein the length of the gaps in the direction towards the second axial end 84*b* of the rotor casing 84 increases.

The maximum length $L_2$ of the profiled elements 88*a*–88*d* of the second row is 53° in this embodiment; since the number of profiled elements of the second row equals the number of profiled elements of the first row, a lower value of 37° results here for the minimum length $L_2$' of the gaps 88*a*'–88*d* ' of the second row.

As is likewise shown in FIG. 5, the profiled elements 88*a*–88*d* of the second row and, therefore, their gaps are offset in relation to the profiled elements of the first row or their gaps contrary to the rotational direction U, wherein the magnitude of this offset or displacement is adjusted to the lengths of the profiled elements or the gaps such that gaps of the two rows which are adjacent to each other in axial direction overlap each other to such an extent in rotational direction U or in circumferential direction of the rotor that they form a through channel in axial direction which extends from the one axial end 84*a* of the rotor casing 84 as far as its other axial end 84*b*. In the embodiment illustrated in FIG. 5, the inside width $L_3$ of this channel is 25°, wherein the inside width is to be understood as that width which the viewer sees in a front view of the rotor in the direction of the axis 34.

In the illustrated preferred embodiment, the lengths of the profiled elements of the first row are approximately equal to the lengths of the gaps of the first row, the lengths of the profiled elements of the second row are greater than the lengths of the profiled elements of the first row, and the lengths of the gaps of the second row are smaller than the lengths of the profiled elements of the second row and smaller than the lengths of the gaps of the first row.

Due to the described arrangement of the profiled elements of the two rows steps 90 result, by means of which the following effect is achieved: Accumulations of fibers and impurities, which can occur at the first flanks I of the profiled elements 86*a*–86*d* of the first row, slide along the first flanks I of the profiled elements of the first row in the direction towards the second axial end 54*b* of the supply chamber 54 on account of the axial flow component of the fiber suspension in the supply chamber 54 and thereby reach the steps 90, in the region of which they are broken up due to the strong turbulences prevailing there and are mixed with the fiber suspension—accumulations of fibers and impurities at the first flanks I of the profiled elements 88*a*–88*d* of the second row are likewise transported in axial direction and reach the rejects chamber 56.

Hereinabove, the lengths of the profiled elements and the gaps have been expressed in circumferential angles. In the practical realization of the inventive pressure sorter, the lengths $L_1$ and $L_2$ are within a range of between approximately 200 mm and approximately 450 mm.

The circumferential speeds of the rotor achieved by the adjustment of the rotational speed of the rotor are expediently between approximately 10 m/s and approximately 40 m/s, wherein the best sorting results are generally achieved with circumferential speeds of approximately 15 to approximately 30 m/s.

If the screen openings 38*a* of the screen 38 are bores, their diameter is expediently approximately 1 mm to approximately 3.5 mm when the rotor is operated with a circumferential speed of approximately 10 to approximately 15 m/s. At higher circumferential speeds, smaller bores can be used; an inventive pressure sorter is expediently operated with circumferential speeds of the rotor of approximately 15 to approximately 40 m/s and bores with a diameter of approximately 0.5 to approximately 1.5 mm are then selected for the screen openings. If the screen openings 38*a* are slots, these ought to have a width of approximately 0.4 to approximately 0.6 mm at circumferential speeds of the rotor of approximately 10 to approximately 15 m/s; in the case of slots, as well, finer screen openings can be used at higher circumferential speeds of the rotor, and since circumferential speeds of the rotor of approximately 15 to approximately 40 m/s are preferred, slot-shaped screen openings with a width of approximately 0.1 mm to approximately 0.35 mm are recommended in this case.

The construction of the profiled elements 86*a*–86*d* and 88*a*–88*d* of the illustrated preferred embodiment results from FIGS. 3 and 4. Each of these profiled elements consists when the rotor casing 84 is disregarded—of a strip 100 forming the first flank I, a curved metal sheet 102 forming the second flank II and two side walls 104, wherein with reference to FIG. 3 it is to be noted that in this Figure, due to the sloped course of the first flanks I and, therefore, the strips 100, the latter have not been cut perpendicular to their longitudinal extension but at an angle thereto. The cavities 106 of the profiled elements enclosed by the rotor casing 84, the strips 100, the metal sheets 102 and the side walls 104 are intended to be liquid-tight or filled with a filling material, such as, for example, a foamed plastic, in order to prevent imbalances resulting in the rotor. The same applies to the cavity of the rotor body 82.

Finally, it is to be noted that the channels with the inside width $L_3$ can be seen particularly clearly in FIG. 4 and are designated as 200.

Figure 6:
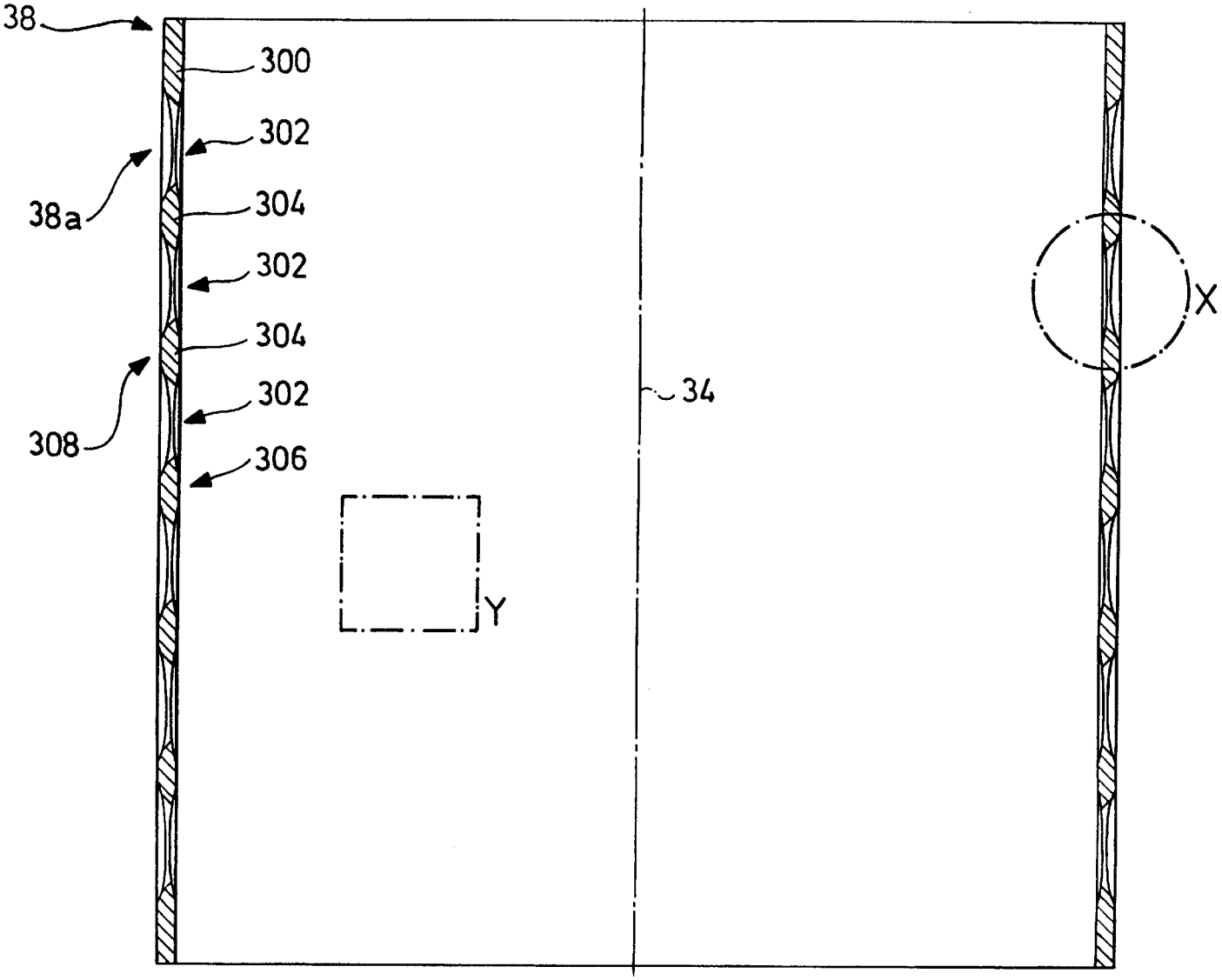
FIG. 6 shows a section through a preferred embodiment of the inventive screen along a plane of diameter containing the axis 34 which also represents the screen axis (the details visible when looking at the inflow side of the screen have, however, been omitted in FIG. 6 for the sake of simplicity)
Figure 8:
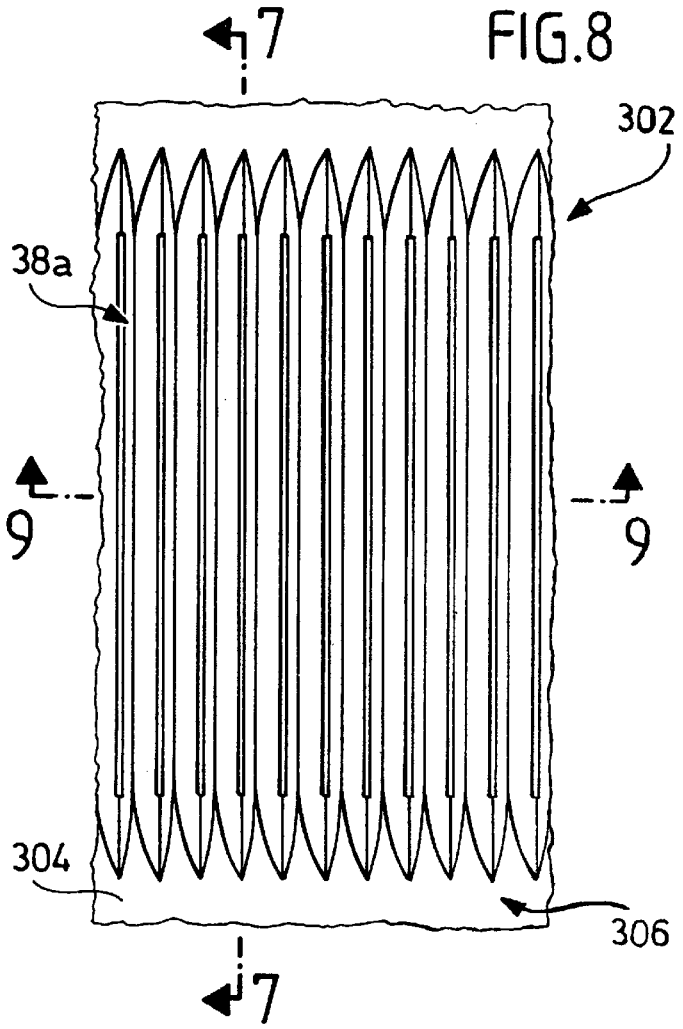
FIG. 8 shows the section "Y" from FIG. 6 on a larger scale.

As shown in FIGS. 6 and 8, several rows 302 (in the illustrated embodiment 6 rows) of screen openings 38*a* are formed in the wall 300 of the screen 38 around the screen axis 34 with ring-shaped webs 304 provided between them, in the regions of which the screen wall 300 has neither screen openings nor a surface profile. As is apparent from a comparison of FIG. 6 with FIG. 1, the inner surface of the circular cylindrical screen 38 concentric to the axis 34 forms its inflow side 306, its outer surface the outflow side 308 of the screen.

Figure 7:
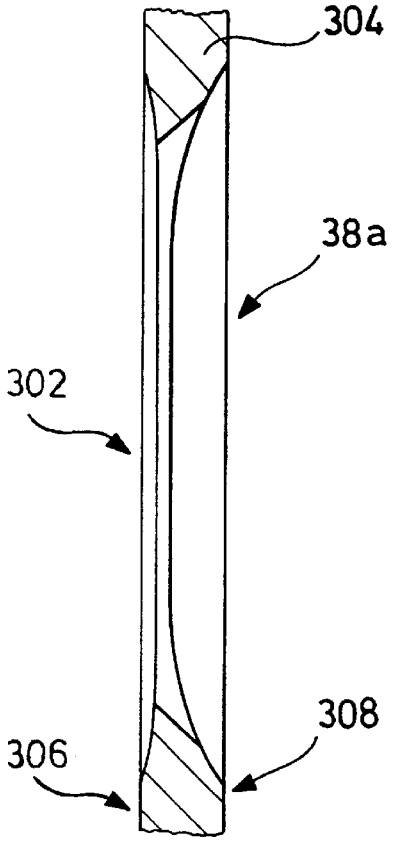
FIG. 7 shows the section "X" from FIG. 6 on a larger scale or rather a section according to line 7—7 in FIG. 8.
Figure 9:
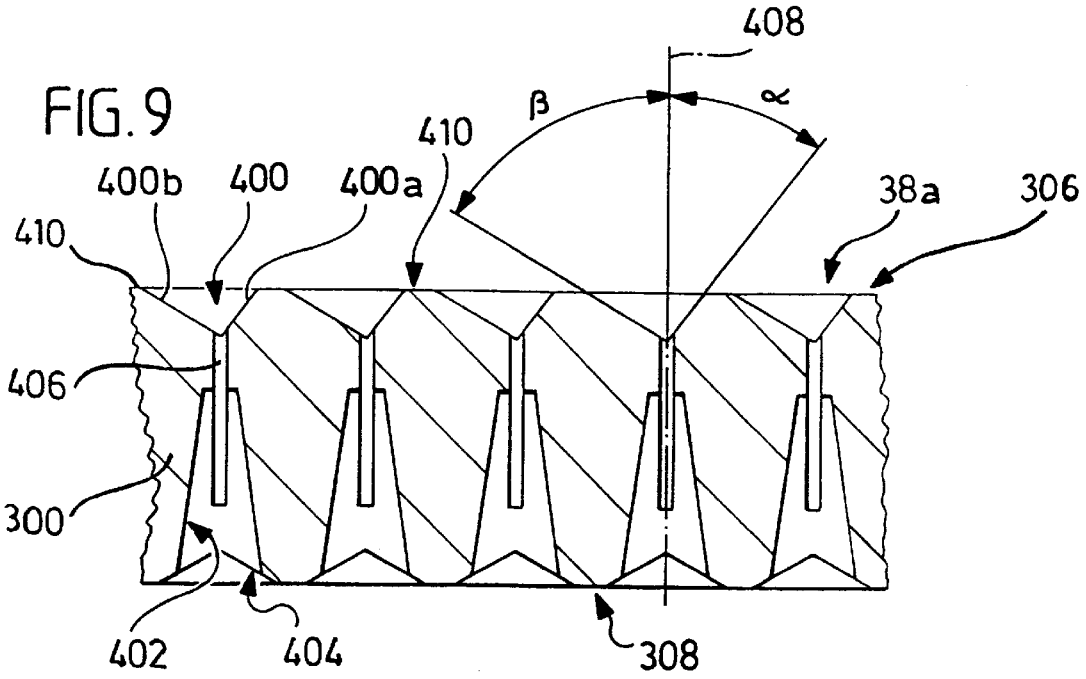
FIG. 9 shows a section through part of the screen wall corresponding to line 9—9 in FIG. 8.

The inventive configuration and arrangement of the screen openings 38*a* is now to be explained in greater detail on the basis of FIGS. 7–9 and, in particular, on the basis of FIG. 9, wherein the screen wall 300 has been drawn in a flat, plane state in FIG. 9 for a more simple illustration, e.g. in that state of the screen wall 300 consisting of stainless sheet steel during the machining and prior to the bending as well as welding to form a circular cylinder.

In the illustrated embodiment of the inventive screen, each of the screen openings 38*a* consists of four components which partially overlap one another, namely of three grooves and a slot. For each screen opening 38*a*, a groove 400 on the inlet side has been milled out of the sheet forming the screen wall 300 from the inflow side 306, from the outflow side 308 first of all an inner groove 402 and then an outer groove 404, the angle of opening of which is greater than that of the inner groove 402. Subsequently, a slot has finally been sawn into the screen wall 300 which forms a screen through-channel 406 connecting the grooves 400 and 402 with one another. The various components of each screen opening 38*a* are arranged relative to one another such that they are all located in a plane of diameter 408 containing the screen axis 34 after the screen wall 300 has been bent to form the circular cylindrical screen 38—this plane of diameter therefore represents the central plane of the slot-shaped screen through-channel 406, likewise the central planes of the grooves 402 and 404 which are designed to be symmetric to this plane of diameter 408, and, finally, the base of the groove 400 is also located in the plane of diameter 408.

In the illustrated preferred embodiment of the inventive screen, the total thickness of the screen wall is approximately 6 mm, the depth of the groove 400 measured at right angles to the inflow side 306 is 1 mm, the distance of the plane base of the groove 402 from the outflow side 308 is 4 mm, and the groove 404 is intended to be 0.72 mm deep. The angle of opening (measured in the plane of drawing of FIG. 9) of the inner groove 402 is intended to be 16°, that of the outer groove 404 120°. As a result, the width of the outer groove 404 measured in circumferential direction of the screen and measured at the outflow side 308 is 2.5 mm. The width of the slot-shaped screen through-channel 406 measured in the same direction (also called slot width) depends on the desired sorting fineness of the screen and is, in particular, 0.1 mm to 0.25 mm.

In FIG. 9, the rotational or circumferential direction of the rotor 36 has been designated as "U", and in this direction the screen has at its inflow side 306 between each two consecutive grooves 400 a surface area 410 which is part of a circular cylindrical surface when the screen wall 300 is bent to form a circular cylinder and its width measured in circumferential direction of the screen or rotational direction of the rotor U is intended to be 0.5 mm in the illustrated preferred embodiment.

In accordance with the invention, each of the grooves 400 has a steeper front groove side wall 400*a* and a flatter rear groove side wall 400*b* which form an angle of 97.5° with one another in the illustrated preferred embodiment whereas the angle $\alpha$ between the front groove side wall 400*a* and the plane of diameter 408 is 37.5°, the angle $\beta$ between the plane of diameter 408 and the rear groove side wall 400*b* 600. With a depth of the grooves 400 of 1 mm, this results in a width of the grooves 400 measured in rotational direction of the rotor U of 2.5 mm. The angle, through which the front groove side wall 400*a* is inclined in relation to the circumferential direction of the screen or the rotational direction of the rotor U, is, consequently, 52.5°, the angle of inclination of the rear groove side wall 400*b* in relation to the circumferential direction of the screen 30°.

The "boat-like" shape of the grooves 400 apparent from FIG. 8 (the same applies for the other grooves 404 and 402) is merely a result of the type of production of the grooves by means of a milling tool in the shape of a circular disk and is at least essentially without importance for the functioning of the inventive screen.

Since the rotor 36 leads to the fact that the fiber suspension still to be sorted flows along the inflow side 306 of the screen 38 essentially in circumferential direction of the screen, the relatively steep front groove side walls 400*a* result in relatively strong turbulences being generated in the grooves 400, a certain underpressure resulting in the vicinity of the front groove side walls 400*a* and the fiber suspension flowing essentially in rotational direction of the rotor U being drawn into the grooves 400; portions of the flow of fiber suspension striking the rear groove side walls 400*b* are "reflected back" into the supply chamber 54 by these groove side walls 400*b*, i.e. deflected into the fiber suspension circulating adjacent to the inflow side 306 of the screen, and thus prevent a fiber fleece which reduces the throughput capacity of the pressure sorter from forming in the fiber suspension to be sorted, adjacent to the inflow side 306 of the screen. Since, as described in the above, the static pressure prevailing in the fiber suspension to be sorted in the supply chamber 54 is greater than the static pressure in the accepts chamber 58, the reduction in pressure via the screen wall 300 already leads to that portion of the fiber suspension to be sorted which can pass through the screen through-channels 406 flowing into the screen through-channels from the inflow side 306; this procedure is aided by the positive pressure pulses generated by the rotor 36 in the fiber suspension to be sorted.

On the other hand, the negative pressure pulses generated by the rotor 36 lead to liquid being drawn back through the screen through-channels 406, i.e. being drawn back from the outflow side 308 to the inflow side 306, whereby the screen through-channels 406 are rinsed free so that they cannot become clogged by fibers, fiber agglomerations and impurities contained in the fiber suspension to be sorted.

Screen through-channels in the form of bores can also take the place of the slot-shaped screen through-channels 406, wherein each of the grooves 400 on the inflow side is then connected to the grooves 402 and 404 on the outflow side via several bores which are located behind one another in the direction at right angles to the plane of drawing in FIG. 9.

As is apparent from the dimensions given above of the screen illustrated in FIG. 9, this has a division of 3 mm compared with a division of 4 mm of a screen which differs from the screen illustrated in FIG. 9 only in that not only the angle $\beta$ but also the angle $\alpha$ is 60°, the angle of opening of the grooves 400 therefore 120°. The smaller division does, however, lead to a free, through surface area of the screen which is bigger by approximately ⅓, and surprisingly an inventive screen leads to an increase in the throughput capacity at least proportionally to the increase in size of the free, through surface area although the front groove side walls 400*a* extend more steeply than in the case of the known screen described above of the company Hermann Finckh Maschinenfabrik GmbH & Co. with grooves on the inflow side designed symmetrically to the planes of diameter 408 and having an angle of opening of 120°.

We claim:

1. Screen for sorting fiber suspensions, said screen having a screen wall being rotationally symmetric to a screen axis and having an inflow side for the fiber suspension to be sorted and an outflow side located opposite thereto for pressure sorters comprising a rotor mounted for rotation about the screen axis and having profiled elements arranged for rotation adjacent to the inflow side of said screen wall for generating positive and negative pressure pulses in the fiber suspension to be sorted, wherein said screen wall has at its inflow side grooves approximately V-shaped in cross section, said grooves extending approximately parallel to the screen axis and following one another in circumferential direction of the screen wall, wherein the screen wall comprises through-channels for communicating said inflow side with said outflow side, said through-channels opening into said grooves, wherein each of the grooves is limited—when seen in the direction of rotation of the profiled elements—by a front groove side wall and a rear groove side wall and has a groove base, said front groove side wall and said rear groove side wall defining a width of each of said grooves at said inflow side of the screen wall, wherein said through-channels open at least approximately into said groove bases and said front groove side wall is inclined to a greater extent in relation to the circumferential direction of the screen wall than said rear groove side wall, and wherein a surface area essentially smooth and at least approximately parallel to said circumferential direction is provided at the inflow side of the screen wall in its circumferential direction between each two consecutive grooves, said surface area having a predetermined width measured in said circumferential direction, and wherein (a) in cross section at right angles to the screen axis said front groove side wall forms with the circumferential direction of the screen wall an angle of approximately 40° to approximately 70°;

(b) in cross section at right angles to the screen axis said front and rear groove side walls form with one another an angle of approximately 80° to approximately 110°;

(c)—when seen in circumferential direction of the screen wall—said predetermined width of each of said surface areas is approximately 20% to approximately 30% of said width of said grooves.

2. Screen as defined in claim 1, wherein said front groove side wall forms with the circumferential direction of the screen wall an angle of approximately 45° to approximately 60°.

3. Screen as defined in claim 2, wherein said front groove side wall forms with the circumferential direction of the screen wall an angle of approximately 50° to approximately 55°.

4. Screen as defined in claim 3, wherein said front groove side wall forms with the circumferential direction of the screen wall an angle of approximately 52° to approximately 53°.

5. Screen as defined in claim 1, wherein said rear groove side wall forms with the circumferential direction of the screen wall an angle of approximately 20° to approximately 40°.

6. Screen as defined in claim 5, wherein said rear groove side wall forms with the circumferential direction of the screen wall an angle of approximately 25° to approximately 35°.

7. Screen as defined in claim 6, wherein said rear groove side wall forms with the circumferential direction of the screen wall an angle of approximately 30°.

8. Screen as defined in claim 1, wherein the angle between said front and rear groove side walls is approximately 90° to approximately 105°.

9. Screen as defined in claim 8, wherein the angle between said front and rear groove side walls is approximately 95° to approximately 100°.

10. Screen as defined in claim 9, wherein the angle between said front and rear groove side walls is approximately 97° to approximately 98°.

11. Screen as defined in claim 1, wherein—in cross section at right angles to the screen axis—a center of the opening of each of said through-channels facing said inflow side is located at least approximately in an intersection of said front and rear groove side walls.

12. Screen as defined in claim 1, wherein said through-channels—in cross section at right angles to the screen axis as well as in relation to the latter—extend approximately in radial direction.

13. Screen as defined in claim 1, wherein—measured in a radial direction in relation to the screen axis—the depth of said grooves is approximately 0.8 mm to approximately 1.2 mm.

14. Screen as defined in claim 13, wherein the depth of said grooves is approximately 0.8 mm to approximately 1 mm.

15. Screen as defined in claim 14, wherein the depth of said grooves is approximately 1 mm.

16. Screen as defined in claim 1, wherein said width of said surface area is approximately equal to ⅕ of the width of said grooves.

17. Screen as defined in claim 1, wherein said screen wall consists of stainless sheet steel.

18. Screen as defined in claim 17 wherein said grooves are designed as recesses produced by a cutting process.

19. Screen as defined in claim 17, wherein said grooves and said through-channels are elements of screen wall openings communicating said inflow side with said outflow side, and wherein the screen wall has a wall thickness of approximately 6 mm to approximately 10 mm outside said screen wall openings.

20. Screen as defined in claim 1, wherein—when looking at said inflow side—said grooves form several rows of grooves extending in circumferential direction of the screen wall and arranged in spaced relation to one another in the direction of the screen axis.

21. Screen as defined in claim 1, wherein said screen wall has recesses at its outflow side, at least one said through-channel opening into each of said recesses.

22. Screen as defined in claim 21, wherein said recesses have the shape of grooves extending approximately parallel to the screen axis.

23. Screen as defined in claim 22, wherein said through-channels are in the form of slots extending approximately parallel to the screen axis, only one single slot opening into each of said grooves provided at the outflow side of the screen wall.

24. Screen as defined in claim 21, wherein in each plane at right angles to the screen axis only one single through-channel opens into each said recess.

25. Screen as defined in claim 1, wherein in each plane at right angles to the screen axis only one single through-channel opens into each said groove provided at the inflow side of the screen wall.

26. Screen as defined in claim 1, wherein said through-channels are in the form of slots extending approximately parallel to the screen axis.

27. Screen as defined in claim 26, wherein only one single slot opens into each of said grooves provided at the inflow side of the screen wall.

28. Pressure sorter for a fiber suspension comprising:

a housing with a stationary screen arranged therein and having a screen wall being rotationally symmetric to a screen axis, said screen wall having an inner inflow side and an outer outflow side and separating in said housing a supply chamber encircled by said screen wall from an accepts chamber located outside said screen wall, and a rotor mounted within said housing for rotation about said screen axis and being drivable in a rotational direction by a motor, said rotor having a periphery, said rotor periphery and said inflow side of said screen limiting said supply chamber in radial direction, said housing having an inlet for said fiber suspension to be treated and a rejects outlet, said inlet communicating with a first axial end of said supply chamber and said rejects outlet communicating with a second axial end of said supply chamber, wherein for generating positive and negative pressure pulses in said fiber suspension profiled elements are provided at said rotor periphery, said profiled elements extending in a circumferential direction of said rotor, where said direction is perpendicular to both said radial direction and said screen axis, and each having a first flank lying in front in said rotational direction for driving said fiber suspension in said rotational direction, as well as a second flank located behind said first flank in a direction opposite to said rotational direction for drawing liquid back from said accepts chamber through said screen into said supply chamber, wherein said screen wall has at its inflow side grooves approximately V-shaped in cross section, said grooves extending approximately parallel to said screen axis and following one another in circumferential direction of said screen wall, wherein said screen wall comprises through-channels for communicating said inflow side with said outflow side, said through-channels opening into said grooves, wherein each of said grooves is limited—when seen in said direction of rotation of said profiled elements—by a front groove side wall and a rear groove side wall and has a groove base, said front groove side wall and said rear groove side wall defining a width of each of said grooves at said inflow side of said screen wall, wherein said through-channels open at least approximately into said groove bases and said front groove side wall is inclined to a greater extent in relation to said circumferential direction of said screen wall than said rear groove side wall, and wherein a surface area essentially smooth and at least approximately parallel to said circumferential direction of said screen wall is provided at said inflow side of said screen wall between two consecutive grooves, said surface area having a predetermined width measured in said circumferential direction of said screen wall, and wherein (a) in cross section at right angles to said screen axis said front groove side wall forms with said circumferential direction of said screen wall an angle of approximately 40° to approximately 70°;

(b) in cross section at right angles to said screen axis said front and rear groove side walls form with one another an angle of approximately 80° to approximately 110°;

(c)—when seen in said circumferential direction of said screen wall—said predetermined width of each of said surface areas is approximately 20% to approximately 30% of said width of said grooves.

29. A method for making a rotationally symmetric screen for sorting fiber suspensions, said method comprising: making a plurality of approximately V-shaped grooves on an inflow side of a plane sheet having first and second ends, each of said plurality of V-shaped grooves on said inflow side having a steeper front groove side wall and a flatter rear groove side wall relative to the plane of said sheet; making a plurality of approximately V-shaped grooves, substantially parallel to said V-shaped grooves on said inflow side of said sheet, on an outflow side opposite to said inflow side of said sheet; connecting an inflow groove, from said plurality of V-shaped grooves on said inflow side of said sheet, to an outflow groove, from said plurality of V-shaped grooves on said outflow side of said sheet, by a plurality of channels; and folding said sheet about a screen axis, parallel to said V-shaped grooves on said inflow side of said sheet, and joining said first and second ends to form a screen wall of said rotationally symmetric screen wherein there is a surface area on said inflow side between adjacent grooves, said surface area being essentially smooth and at least approximately parallel to a circumferential direction of said screen wall, said surface area having a predetermined width measured in said circumferential direction of said screen wall, and wherein (a) in cross section at right angles to said screen axis said front groove side wall forms with said circumferential direction of said screen wall an angle of approximately 40° to approximately 70°;

(b) in cross section at right angles to said screen axis said front and rear groove side walls form with one another an angle of approximately 80° to approximately 110°; and (c)—when seen in said circumferential direction of said screen wall—said predetermined width of each of said surface areas is approximately 20% to approximately 30% of said width of said grooves on said inflow side.

30. The method of claim 29 wherein said V-shaped grooves on said inflow side and said V-shaped grooves on said outflow side are made by milling operations.

31. The method of claim 29 wherein said V-shaped grooves on said outflow side are made by two milling operations.

32. The method of claim 29 wherein at least one of said plurality of channels is a slot.

33. The method of claim 29 wherein at least one of said plurality of channels is a bore.

34. The method of claim 29 wherein said plurality of channels connecting an inflow groove to an outflow groove are located behind one another in a direction approximately parallel to said screen axis.

35. A screen made according to the method of claim 29, wherein a rotor rotating about said screen axis, and on said inflow side of said screen, is used to create positive and negative pressure pulses in sorting said fiber suspensions.

36. A screen made according to the method of claim 29 wherein said screen is used to sort said fiber suspensions by applying said fiber suspensions to said inflow side and collecting sorted fiber suspensions at said outflow side of said screen.

* * * * *